US009946213B2

(12) United States Patent
Nakabayashi

(10) Patent No.: US 9,946,213 B2
(45) Date of Patent: Apr. 17, 2018

(54) IMAGE FORMING APPARATUS THAT PREVENTS SHEET FROM FALLING AT TIME OF JAM PROCESSING

(71) Applicant: CANON KABUSHIKI KAISHA, Tokyo (JP)

(72) Inventor: Junichiro Nakabayashi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/364,712

(22) Filed: Nov. 30, 2016

(65) Prior Publication Data

US 2017/0160695 A1 Jun. 8, 2017

(30) Foreign Application Priority Data

Dec. 4, 2015 (JP) ..... 2015-237394

(51) Int. Cl.
*G03G 15/00* (2006.01)
*G03G 21/16* (2006.01)

(52) U.S. Cl.
CPC ..... *G03G 15/70* (2013.01); *G03G 21/1633* (2013.01); *G03G 21/1638* (2013.01); *G03G 2215/0129* (2013.01)

(58) Field of Classification Search
CPC ..... G03G 15/70
USPC ..... 399/21
See application file for complete search history.

(56) References Cited

U.S. PATENT DOCUMENTS 6,697,177 B1 * 2/2004 Tomoe ..... H04N 1/00572 271/225
8,573,593 B2 * 11/2013 Shiraishi ..... B65H 5/062 271/258.01
9,651,913 B2 * 5/2017 Koshida ..... B65H 29/52
2013/0135646 A1 * 5/2013 Akiyama ..... G06F 3/12 358/1.13
2015/0125165 A1 * 5/2015 Takenaka ..... B65H 15/00 399/21
2015/0277323 A1 * 10/2015 Yamazaki ..... G03G 15/5012 399/21

FOREIGN PATENT DOCUMENTS

JP 2000247525 A 9/2000

* cited by examiner

*Primary Examiner* — Anthony Nguyen
(74) *Attorney, Agent, or Firm* — Rossi, Kimms & McDowell LLP

(57) ABSTRACT

An image forming apparatus capable of preventing a sheet from falling during jam handling without adding a special mechanism. The apparatus has an openable door forming a guide wall of a first path in a closed state. A first pair of rollers are disposed on the first path for nipping and conveying a sheet in a door closed state, and separated from each other when the door is opened. A second path is connected to the first path, for conveying downstream a sheet from the first path. A second pair of rollers disposed on the second path can keep nipping a sheet even when the door is opened. If a jam occurs, a sheet remaining in the first path is conveyed into the second path using the first roller pair, and is nipped by the second roller pair.

8 Claims, 9 Drawing Sheets

IMAGE FORMING APPARATUS THAT PREVENTS SHEET FROM FALLING AT TIME OF JAM PROCESSING

BACKGROUND OF THE INVENTION

Field of the Invention

The present invention relates to an image forming apparatus that is capable of preventing a sheet from falling and going astray at the time of jam handling processing.

Description of the Related Art

Conventionally, an image forming apparatus, such as a copy machine, is provided with an inversion conveying section for inverting the front and reverse sides of a sheet to perform face-down discharge or double-sided printing. The inversion conveying section has a conveyance path for conveying a sheet in a vertical direction, and is configured to convey a sheet in a state nipped between pairs of rollers disposed on sheet guide walls on opposite sides of the conveyance path, and invert the front and reverse sides of the sheet by switching back the sheet. Further, to make it easy to remove a sheet remaining in the conveyance path when a jam occurs, the inversion conveying section is configured to have, for example, a structure capable of being opened and closed by forming one of the guide walls inside an opening/closing door of the image forming apparatus.

In the inversion conveying section having the structure capable of being opened and closed, when one of the guide walls is opened to perform jam handling processing, nipping of a sheet between the pairs of rollers is released so that the sheet remaining in the conveyance path falls. As a result, the sheet goes astray outside the image forming apparatus, and even when a sheet falls within the apparatus, the sheet may slide into a place where it is difficult for a user to take out the sheet. For this reason, the inversion conveying section capable of being opened and closed is a factor that lowers the jam handling processing performance of the image forming apparatus.

Incidentally, the reason why a sheet falls when one of the guide walls of the inversion conveying section is opened is that one of the rollers of each roller pair within the conveyance path is disposed on one of the guide walls which is capable of being opened and closed, and cannot keep nipping the sheet when the one of the guide walls is opened. To solve this problem, there has been proposed a sheet conveying device or an image forming apparatus that is additionally provided with a retaining member for retaining a sheet, and causes the retaining member to move to a position where it retains the sheet, in a manner interlocked with opening of the guide wall, to thereby prevent the sheet from falling (see Japanese Patent Laid-Open Publication No. 2000-247525).

However, the above-mentioned conventional technique has a problem that it is necessary to add a new mechanism to the inversion conveying section, and hence a dedicated space for the new mechanism is required, thus leading to an increase in the manufacturing cost.

SUMMARY OF THE INVENTION

The present invention provides an image forming apparatus that is capable of preventing a sheet from falling at the time of jam handling processing without adding a special mechanism.

In a first aspect of the present invention, there is provided an image forming apparatus comprising a first conveyance path along which a sheet is conveyed, a door, which can be opened and closed, configured to form a guide wall of the first conveyance path in a closed state, a first pair of rollers, which are disposed on the first conveyance path, configured to nip and convey a sheet in a state in which the door is closed, and be separated from each other in a state in which the door is opened, a second conveyance path, which is connected to the first conveyance path, configured to convey a sheet conveyed from the first conveyance path, to a downstream side, a second pair of rollers, which are disposed on the second conveyance path, configured to nip and convey a sheet, and be capable of keeping nipping of the sheet even when the door is opened, and a controller configured to cause, in a case where a jam of the sheet occurs at a position downstream of the second roller pair, a sheet remaining in the first conveyance path to be conveyed into the second conveyance path using the first pair of rollers, and to be nipped by the second pair of rollers.

According to the present invention, when a jam has occurred, the conveyance of sheets is controlled such that a sheet remaining in the first conveyance path is conveyed into the second conveyance path using the first pair of rollers, so as to be nipped by the second pair of rollers, and hence it is possible to prevent the sheet from falling at the time of jam handling processing without adding a special mechanism.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
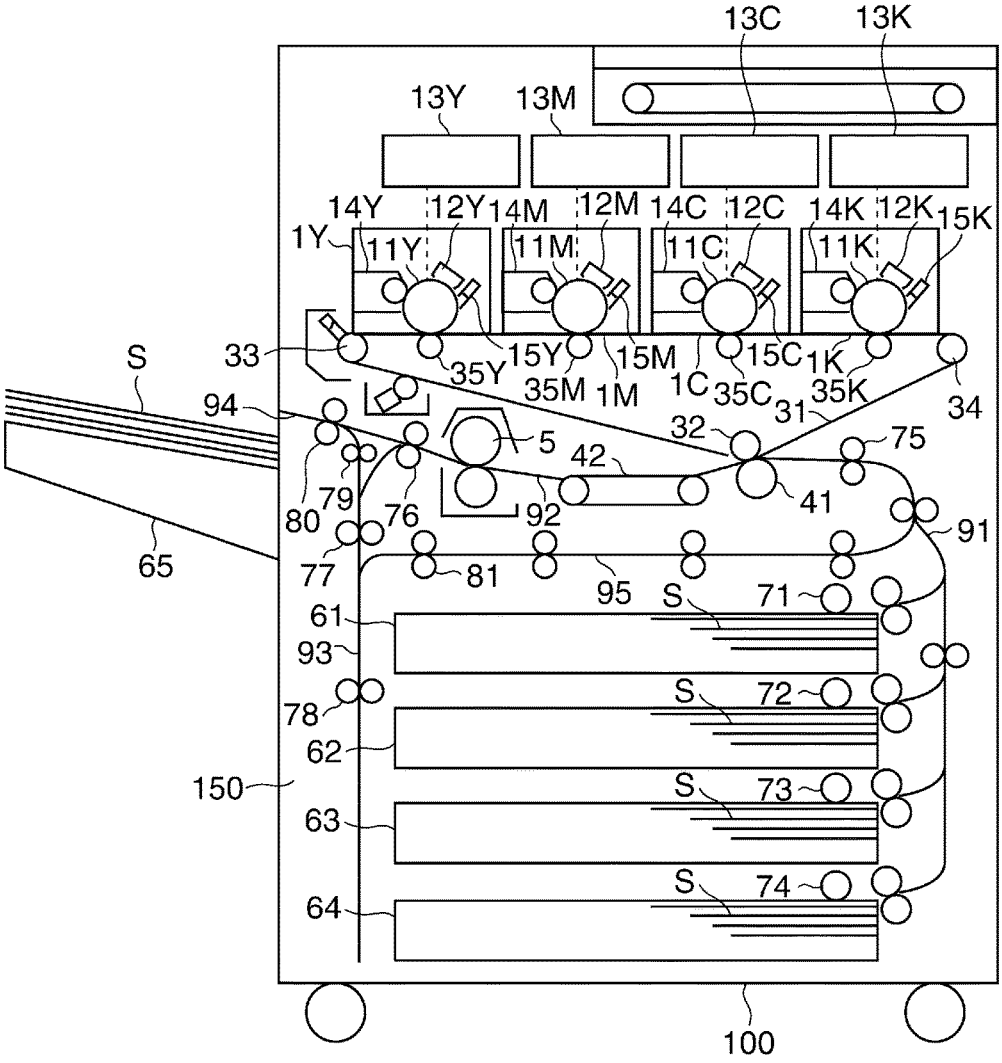
FIG. 1 is a schematic cross-sectional view of an image forming apparatus according to an embodiment of the present invention.

FIG. 1 is a schematic cross-sectional view of an image forming apparatus 100 according to an embodiment of the present invention. This image forming apparatus 100 is an image forming apparatus of a tandem-type intermediate transfer system, in which a plurality of image forming stations are serially arranged along a horizontal portion of an intermediate transfer belt. The image forming apparatus 100 is mainly comprised of an image forming section located at an upper part of the apparatus body, an intermediate transfer section and a sheet feeder, which are located below the image forming section, and a sheet conveying section that conveys a sheet fed from the sheet feeder. The image forming apparatus 100 forms a full-color image on a sheet S by an electrophotographic method according to an image signal transmitted e.g. from an external apparatus.

Referring to FIG. 1, the image forming section of the image forming apparatus 100 includes image forming stations 1Y, 1M, 1C, and 1K for forming yellow, magenta, cyan, and black toner images, respectively. The image forming stations 1Y, 1M, 1C, and 1K include photosensitive drums 11Y, 11M, 11C, and 11K, respectively.

Around the photosensitive drums 11Y to 11K, there are arranged charging rollers 12Y to 12K for uniformly charging the surfaces of the respective associated photosensitive drums 11Y to 11K, and exposure devices 13Y to 13K each for irradiating an image light to an associated one of the photosensitive drums 11Y to 11K to thereby form an electrostatic latent image on the surface of each photosensitive drum. Further, around the photosensitive drums 11Y to 11K, there are arranged developing devices 14Y to 14K for developing the electrostatic latent images formed on the associated photosensitive drums to thereby form toner images, respectively, and cleaning devices 15Y to 15K for eliminating toner remaining on the photosensitive drums after transferring the toner images.

The intermediate transfer belt, denoted by reference numeral 31, is tensioned by a drive roller 33, a tension roller 34, and a transfer opposed roller 32, in a rotatable manner. The intermediate transfer belt 31 is rotated in a manner brought into sliding contact with the photosensitive drums 11Y to 11K of the respective image forming stations. On an inner peripheral side of the intermediate transfer belt 31, there are disposed primary transfer rollers 35Y, 35M, 35C, and 35K at respective locations opposed to the photosensitive drums 11Y to 11K.

The toner images of the respective colors, formed on the photosensitive drums 11Y to 11K of the image forming stations 1Y to 1K, are transferred onto the intermediate transfer belt 31 by the primary transfer rollers 35Y to 35K, respectively, in a superimposed relation, and as a result, a full-color toner image is formed.

The sheet feeder includes sheet feed cassettes 61, 62, 63, and 64, and sheet feed rollers 71, 72, 73, and 74, which are disposed at upper end portions of the sheet feed cassettes 61 to 64, respectively. The sheet conveying section includes a sheet feed path 91, a conveying belt 42, a fixing conveyance path 92, an inversion conveyance path 93, a discharge conveyance path 94, a double-sided conveyance path 95, etc., and various rollers and various sensors, disposed in these conveyance paths.

Sheets S stored in the sheet feed cassettes 61, 62, 63, and 64 each are conveyed from one of the feed rollers 71 to 74 to the sheet feed path 91, brought into abutment with a registration roller 75 in a stopped state, and stopped. The registration roller 75 delivers a sheet S to a secondary transfer section in synchronism with a full-color toner image transferred onto the intermediate transfer belt 31. The full-color toner image on the intermediate transfer belt 31 is transferred onto the sheet S by applying a predetermined transfer bias to a secondary transfer roller 41.

The sheet S on which the full-color toner image has been transferred is conveyed into the fixing conveyance path 92 by the conveying belt 42, and is conveyed into a fixing device 5. The fixing device 5 applies heat and pressure to the full-color toner image on the sheet S to thereby melt the same, and fixes the same onto the surface of the sheet S. The sheet S having the full-color toner image fixed thereon is discharged onto a discharge tray 65 via the discharge conveyance path 94.

Next, a description will be given of an inversion conveyance path as part of the sheet conveying section. The inversion conveyance path is a conveyance path for conveying a sheet so as to invert the front and reverse sides of the sheet as required.

Figure 2:
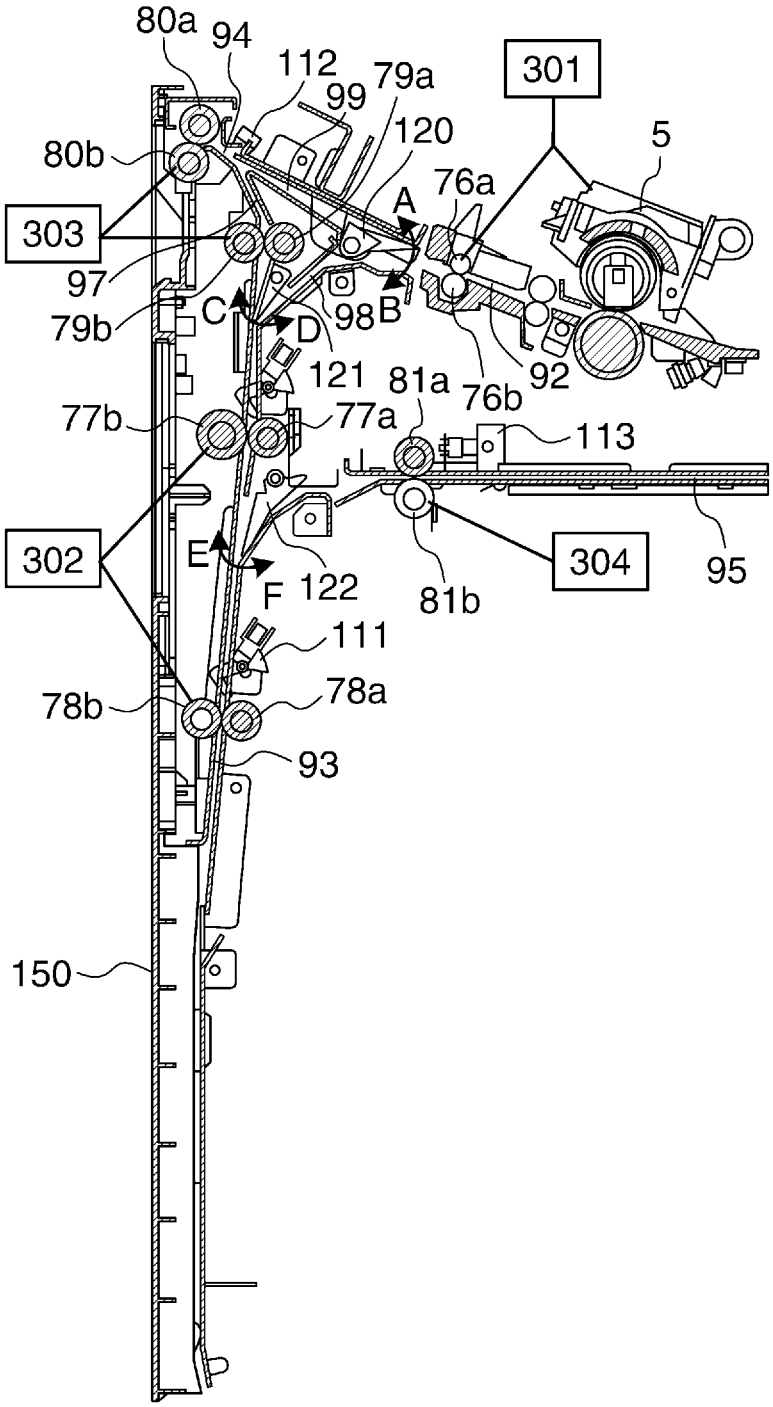
FIG. 2 is an enlarged cross-sectional view of an inversion conveying section of the image forming apparatus.

FIG. 2 is an enlarged cross-sectional view of an inversion conveying section in the image forming apparatus.

Referring to FIG. 2, the inversion conveying section includes the fixing conveyance path 92, an upper discharge conveyance path 99, a lower discharge conveyance path 98, the discharge conveyance path 94, a linking conveyance path 97, and the inversion conveyance path 93. The fixing conveyance path 92 is a conveyance path downstream of the fixing device 5, and the upper discharge conveyance path 99 and the lower discharge conveyance path 98 are conveyance paths which branch from the fixing conveyance path 92. The discharge conveyance path 94 is connected to the upper discharge conveyance path 99 and extends to a discharge outlet of the image forming apparatus 100. The inversion conveyance path 93 is connected to the lower discharge conveyance path 98. The inversion conveyance path 93 is a conveying path along which a sheet is conveyed so as to invert the front and rear sides of the sheet. One of guide walls of the inversion conveyance path 93 is a left door 150, which is configured to be openable and closable. The linking conveyance path 97 connects the inversion conveyance path 93 and the discharge conveyance path 94.

On the fixing conveyance path 92, there is disposed an inner discharge roller pair 76 formed by a pair of rollers 76*a* and 76*b*. The inner discharge roller pair 76 is driven by a fixing motor 301. That is, by rotating the fixing motor 301, the inner discharge roller pair 76 is caused to convey a sheet S from the fixing conveyance path 92 toward the discharge conveyance path 94 or the inversion conveyance path 93.

At a point of branching into the upper discharge conveyance path 99 and the lower discharge conveyance path 98, there is disposed a discharge flapper 120. The discharge flapper 120 is connected to a discharge solenoid 311 (see FIG. 3), and is moved in a direction A in FIG. 2 by turning off the discharge solenoid 311. With this movement, a sheet S conveyed from the fixing conveyance path 92 is conveyed toward the inversion conveyance path 93. Further, by turning on the discharge solenoid 311, the discharge flapper 120 is moved in a direction B in FIG. 2, whereby the sheet S is conveyed toward the discharge conveyance path 94.

On the inversion conveyance path 93, there are disposed a lower inversion roller pair 78 formed by two rollers 78*a* and 78*b*, and an upper inversion roller pair 77 formed by two rollers 77*a* and 77*b*, along the vertical direction. The respective two rollers 78*a* and 78*b* and 77*a* and 77*b* of the lower inversion roller pair 78 and the upper inversion roller pair 77 are configured such that they can be separated from each other and be brought into abutment with each other. Note that the term "vertical direction" mentioned here refers to a broad concept including a substantially vertical direction. The lower inversion roller pair 78 and the upper inversion roller pair 77 are driven by an inversion motor 302. That is, by normally rotating the inversion motor 302, the lower inversion roller pair 78 and the upper inversion roller pair 77 convey the sheet S downward along the inversion conveyance path 93 while nipping the sheet S. Further, by reversely rotating the inversion motor 302, the lower inversion roller pair 78 and the upper inversion roller pair 77 convey the sheet S upward along the inversion conveyance path 93 while nipping the sheet S.

On the linking conveyance path 97 connecting the inversion conveyance path 93 and the discharge conveyance path 94, there is disposed a pre-discharge roller pair 79 formed by two rollers 79*a* and 79*b*. Further, a discharge roller pair 80 formed by two rollers 80*a* and 80*b* is disposed at an outlet of the discharge conveyance path 94. The pre-discharge roller pair 79 and the discharge roller pair 80 are driven by a discharge motor 303 so as to discharge a sheet S conveyed from the fixing conveyance path 92 or the inversion conveyance path 93, from the image forming apparatus 100.

At a point where the inversion conveyance path 93 is connected to the linking conveyance path 97 and the lower discharge conveyance path 98, there is disposed an inversion flapper 121. The inversion flapper 121 is urged by a spring, not shown, in a direction D in FIG. 2. Therefore, when a sheet S is conveyed from the fixing conveyance path 92 into the inversion conveyance path 93, the inversion flapper 121 is moved in a direction C in FIG. 2 by a force with which the sheet S is conveyed to thereby enable the sheet S to enter the inversion conveyance path 93. On the other hand, when the sheet S is conveyed upward along the inversion conveyance path 93, since the inversion flapper 121 is in the state urged in the direction D in FIG. 2, the inversion flapper 121 enables the sheet S to be conveyed toward the discharge conveyance path 94.

The double-sided conveyance path 95 is connected to the inversion conveyance path 93 at a location between the upper inversion roller pair 77 and the lower inversion roller pair 78. The double-sided conveyance path 95 is a conveyance path along which a sheet having an image printed on the first surface thereof is conveyed as to have an image printed on the second side of the sheet, during double-sided printing. At a point where the inversion conveyance path 93 and the double-sided conveyance path 95 are connected, there is disposed a double-sided path flapper 122. A double-sided path roller pair 81 formed by two rollers 81*a* and 81*b* is disposed in the vicinity of the portion where the inversion conveyance path 93 and the double-sided conveyance path 95 are connected. The double-sided path roller pair 81 is driven by a double-sided path motor 304 to convey a sheet S into the double-sided conveyance path 95.

The double-sided path flapper 122 is connected to a double-sided path solenoid 312 (see FIG. 3), and by turning on the double-sided path solenoid 312, the double-sided path flapper 122 is moved in a direction E in FIG. 2. As a result, the sheet S conveyed upward along the inversion conveyance path 93 is conveyed into the double-sided conveyance path 95. Note that the double-sided path flapper 122 is in a state moved in a direction F in FIG. 2 in a normal state in which the double-sided path solenoid 312 is turned off, and in this state, the sheet S being conveyed upward along the inversion conveyance path 93 is conveyed toward the discharge conveyance path 94. An inversion sensor 111 provided on the inversion conveyance path 93, a discharge sensor 112 provided on the discharge conveyance path 94, and a double-sided path sensor 113 provided on the double-sided conveyance path 95 each are a sensor for detecting a sheet.

Next, a description will be given of the control configuration of the image forming apparatus 100 shown in FIG. 1.

Figure 3:
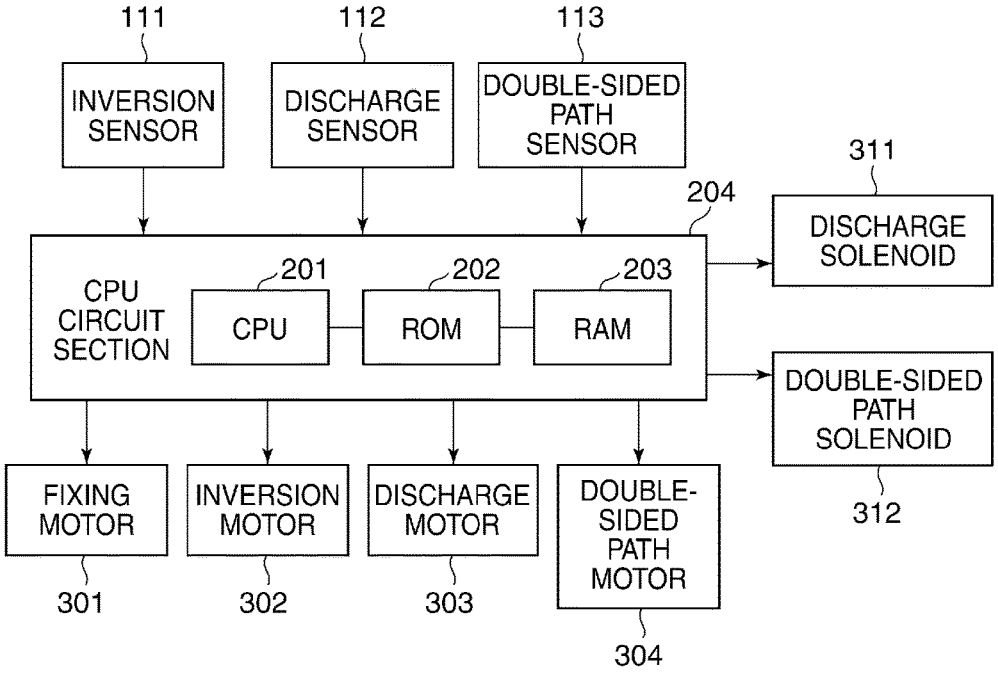
FIG. 3 is a control block diagram of the image forming apparatus.

FIG. 3 is a control block diagram of the image forming apparatus 100.

Referring to FIG. 3, the image forming apparatus 100 includes a CPU circuit section 204, and the CPU circuit section 204 includes a CPU 201, and a ROM 202 and a RAM 203, which are connected to the CPU 201.

The CPU 201 controls the overall operation of the image forming apparatus 100. The ROM 202 stores programs for the operation of the CPU 201. The RAM 203 functions as a storage section used by the CPU 201 for temporary storage of data.

The inversion sensor 111, the discharge sensor 112, and the double-sided path sensor 113 are connected to the CPU 201 of the CPU circuit section 204, and each detect a sheet S. Sheet detection results of these sensors are input to the CPU 201, and the CPU 201 controls conveyance of the sheet S using the sheet detection results.

The fixing motor 301, the inversion motor 302, the discharge motor 303, and the double-sided path motor 304 are connected to the CPU circuit section 204, and drive the respective associated rollers of the conveying section according to instructions from the CPU 201. That is, the CPU 201 causes the sheet S to be conveyed by controlling the fixing motor 301, the inversion motor 302, the discharge motor 303, and the double-sided path motor 304.

Further, the discharge solenoid 311 and the double-sided path solenoid 312 are connected to the CPU circuit section 204. As mentioned above, the discharge solenoid 311 and the double-sided path solenoid 312 are connected to the discharge flapper and the double-sided path flapper, respectively, and the CPU 201 decides to which conveyance path the sheet S should be conveyed by controlling these solenoids.

The following description will be given of the operation of the inversion conveying section of the image forming apparatus 100 in detail.

The inversion conveying section causes a sheet S conveyed from the fixing conveyance path 92 to be sent into the inversion conveyance path 93, and switches back the sheet S in the inversion conveyance path 93 to thereby invert the front and reverse sides of the sheet S. The inversion conveyance path 93 conveys the inverted sheet S to one of the discharge conveyance path 94 and the double-sided conveyance path 95. The sheet S conveyed into the discharge conveyance path 94 is discharged from the image forming apparatus 100. Further, the sheet S conveyed into the double-sided conveyance path 95, on which an image has been formed on the front side thereof, is conveyed to the secondary transfer section again so as to further form an image on the reverse side thereof.

That is, the operations of the inversion conveying section include (1) the operation of straightly discharging a sheet S without inverting the sheet S, (2) the inverted discharge operation of inverting the front and reverse sides of a sheet S, and discharging the inverted sheet S, and (3) the operation of inverting the front and reverse sides of a sheet S, and conveying the sheet S to perform printing on the reverse side. The following description will be given of these operations with reference to FIG. 2.

(1) The Operation of Straightly Discharging a Sheet S without Inverting the Sheet S The sheet S having passed through the fixing device 5 is nipped and conveyed by the inner discharge roller pair 76. At this time, the discharge flapper 120 is in the state moved in the direction B in FIG. 2, and the sheet S is guided into the discharge conveyance path 94 via the fixing conveyance path 92 and the upper discharge conveyance path 99. After that, the sheet S is nipped and conveyed by the discharge roller pair 80, and is discharged from the image forming apparatus 100.

(2) The Inverted Discharge Operation of Inverting the Front and Reverse Sides of a Sheet S, and Discharging the Inverted Sheet S The sheet S having passed through the fixing device 5 is conveyed in a state in which the flapper 120 is moved in the direction A in FIG. 2, whereby the sheet S is conveyed into the inversion conveyance path 93 via the lower discharge conveyance path 98. The sheet S conveyed into the inversion conveyance path 93 is switched back in the inversion conveyance path 93, whereby the front and reverse sides of the sheet S are inverted. More specifically, the sheet S is conveyed downward along the inversion conveyance path 93 by the upper inversion roller pair 77 and the lower inversion roller pair 78, and is temporarily stopped at a position where a trailing edge of the sheet S has passed through the flapper 121. Hereafter, the position where a trailing edge of the sheet has passed through the flapper 121 is referred to as the "inversion stop position".

After the sheet S has been stopped at the inversion stop position, the inversion motor 302 is rotated to thereby convey the sheet S upward along the inversion conveyance path 93. At this time, the flapper 121 is urged in the direction D in FIG. 2, and hence the sheet S is conveyed toward the pre-discharge roller pair 79 via the linking conveyance path 97, and is conveyed by the pre-discharge roller pair 79 so as to be guided to the discharge conveyance path 94. After that, the sheet S is nipped and conveyed by the discharge roller pair 80, and is discharged out of the image forming apparatus 100 as an inverted sheet.

(3) The Operation of Inverting the Front and Reverse Sides of a Sheet S, and Conveying the Sheet S to Perform Printing on the Reverse Side The sheet S having passed through the fixing device 5 is conveyed from the fixing conveyance path 92 into the inversion conveyance path 93 via the lower discharge conveyance path 98. The operation up to this stage is the same as in the case of the inverted discharge operation in which the front and reverse sides of a sheet S are inverted. The sheet S conveyed into the inversion conveyance path 93 is temporarily stopped at a position where the trailing edge of the sheet S has passed through the double-sided path flapper 122. After that, the flapper 122 is moved in the direction E in FIG. 2, and the inversion motor 302 is reversely rotated, whereby the sheet S is conveyed into the double-sided conveyance path 95. The sheet S conveyed into the double-sided conveyance path 95 is sent to the secondary transfer section (see FIG. 1) again so as to perform printing on the second side in double-sided printing.

Incidentally, the left door 150 as a guide door forming the guide walls of the inversion conveyance path 93 of the inversion conveying section is configured to be openable and closable as mentioned above. That is, the inversion conveyance path 93 is formed in a state in which the left door 150 is closed.

Figure 4A:
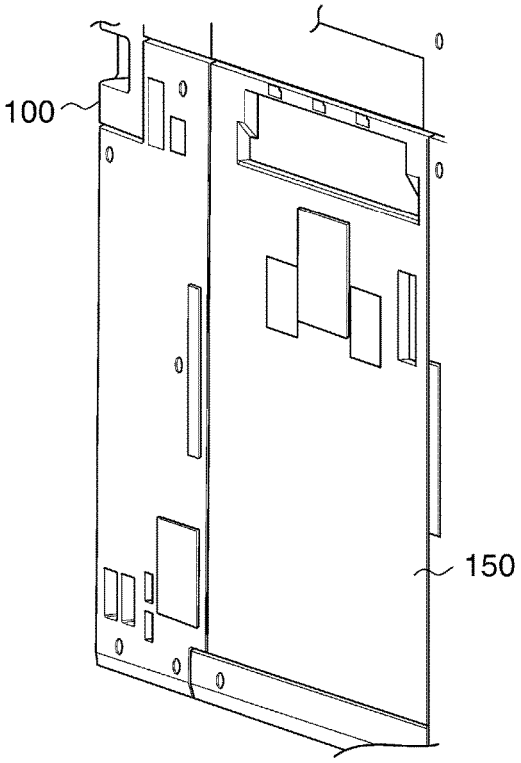
FIG. 4A is a view of a left side of the image forming apparatus in a state in which a left door thereof is closed.
Figure 4B:
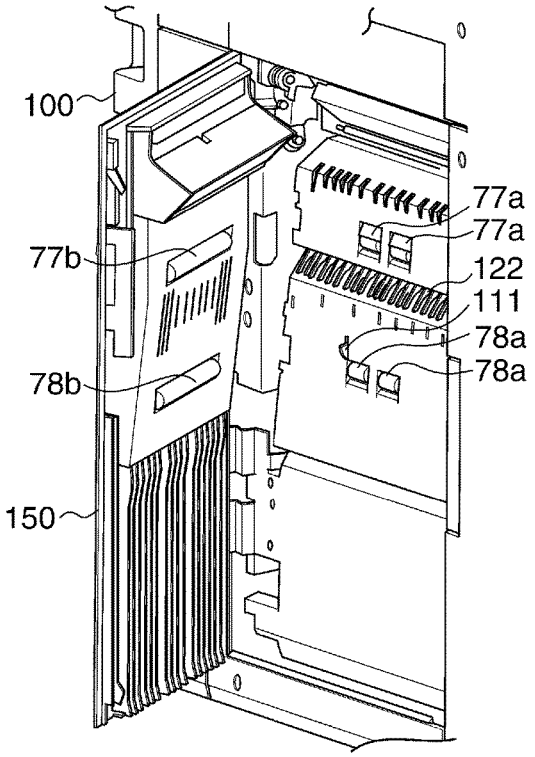
FIG. 4B is a view of the left side of the image forming apparatus in a state in which the left door is opened.

FIGS. 4A and 4B are views each showing a left side of the image forming apparatus 100 shown in FIG. 1, in which FIG. 4A shows a state in which the left door 150 is closed, and FIG. 4B shows a state in which the left door 150 is opened.

Referring to FIGS. 4A and 4B, the inner side of the left door 150 forms one of the guide walls of the inversion conveyance path 93. With this configuration, if a sheet S remains in the inversion conveyance path 93 due to occurrence of a paper jam (hereinafter referred to as the "jam"), the remaining sheet can be easily removed by opening the left door 150.

However, since the upper inversion roller 77*b* and the lower inversion roller 78*b* are disposed on the left door 150, when the left door 150 is opened, the sheet S is released from a state nipped by the roller pair. Therefore, if the sheet S remains at a position where the sheet is nipped by the upper inversion roller pair 77 and/or the lower inversion roller pair 78, the remaining sheet S is no longer supported when the left door 150 is opened, and falls and goes astray.

To solve this problem, in the present embodiment, the sheet S remaining in the inversion conveyance path 93 is prevented from falling when the left door 150 is opened in the following manner.

Figure 5A:
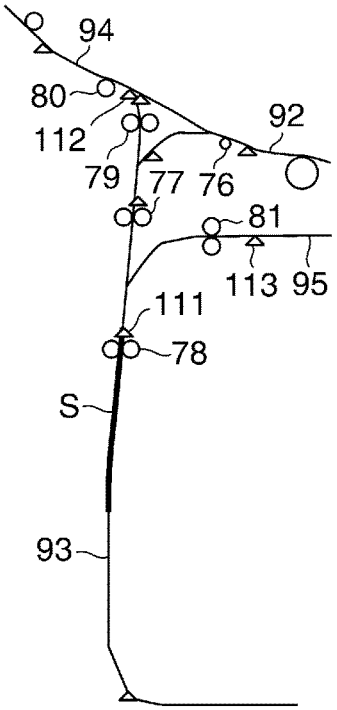
FIGS. 5A to 5C are diagrams useful in explaining the structure of the inversion conveying section and sheet remaining states at jam occurrence times.
Figure 5B:
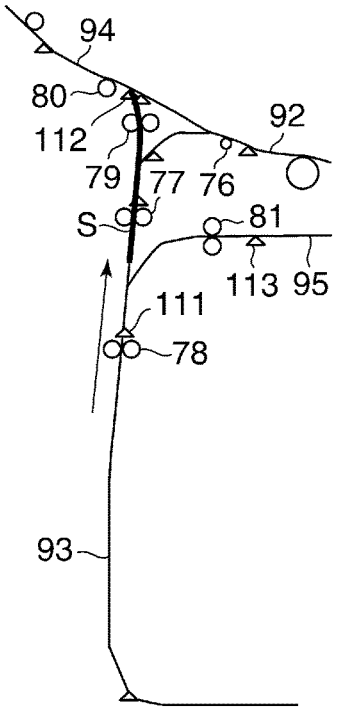
Figure 5C:
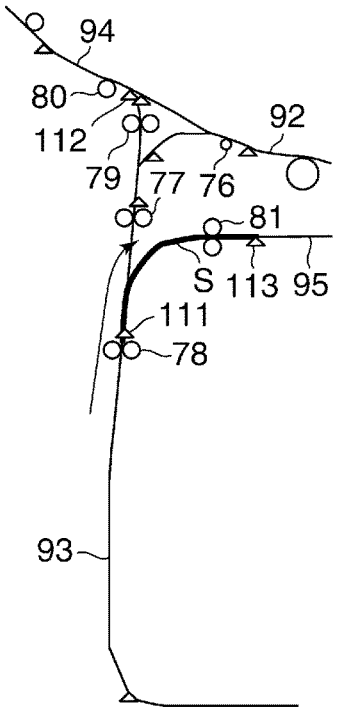

FIGS. 5A to 5C are diagrams useful in explaining the structure of the inversion conveying section and a state of a sheet remaining when a jam has occurred.

In a case where a sheet S subjected to single-sided printing is to be discharged from the inversion conveying section with an image-formed surface thereof facing downward (inverted discharge), or in a case where printing on the second side is to be performed in double-sided printing, it is necessary to invert the front and reverse sides of the sheet S in the inversion conveying section. In doing this, if a jam occurs in a conveyance path downstream of the inversion conveyance path 93, it is impossible to discharge the sheet S remaining in the inversion conveyance path 93 out of the image forming apparatus 100, or it is impossible to convey the sheet S to the double-sided conveyance path 95. Therefore, in this case, the sheet S remains at a position indicated in FIG. 5A in the inversion conveyance path 93. In this case, the sheet S is nipped only by the lower inversion roller pair 78, and hence if the left door 150 is opened to perform jam handling processing, the sheet S falls.

To prevent the sheet S from falling, when a jam occurs, the sheet S remaining in the inversion conveyance path 93 is conveyed to a position downstream of the inversion conveyance path 93, indicated in FIG. 5B, and is stopped. More specifically, the sheet S is conveyed to a position where the discharge sensor 112 detects the sheet S, and after the discharge sensor 112 detects the sheet S, the conveyance of the sheet S is stopped. As a result, the sheet S is in a state nipped by the pre-discharge roller pair 79. The pre-discharge roller pair 79 is not disposed on the left door 150. Therefore, even when the left door 150 is opened, the pre-discharge roller pair 79 can keep nipping the sheet S, whereby the sheet S is prevented from falling even when the left door 150 is opened to perform jam handling processing.

Similarly, by conveying the sheet S to a position indicated in FIG. 5C, it is also possible to prevent the sheet S from falling when the left door 150 is opened. More specifically, the sheet S is conveyed into the double-sided conveyance path 95, and after the sheet S is conveyed to a position where the double-sided path sensor 113 detects the sheet S, the conveyance of the sheet S is stopped. As a result, the sheet S is in a state nipped by the double-sided path roller pair 81. The double-sided path roller pair 81 can keep nipping the sheet S even when the left door 150 is opened, similarly to the pre-discharge roller pair 79, and hence the sheet S is prevented from falling even when the left door 150 is opened to perform jam handling processing.

Any one of the methods of preventing the sheet S from falling, shown in FIGS. 5B and 5C, may be employed, but these methods are performed assuming that no preceding sheet remains, which becomes an obstacle to the operation of causing the pre-discharge roller pair 79 or the double-sided path roller pair 81 to nip the sheet. Note that the preceding sheet which becomes an obstacle to the operation of causing the pre-discharge roller pair 79 or the double-sided path roller pair 81 to nip the sheet is a sheet being conveyed in precedence to the sheet remaining in the inversion conveyance path 93, and remains in the vicinity of the pre-discharge roller pair 79 or the double-sided path roller pair 81.

Further, one of the above-described methods may be selected according to whether the sheet S is a sheet to be subjected to inverted discharge, or a sheet to be subjected to double-sided printing. That is, if the sheet S is a sheet to be subjected to inverted discharge, the method shown in FIG. 5B is selected, whereas if the sheet S is a sheet to be subjected to double-sided printing, the method shown in FIG. 5C is selected.

The following description will be given of jam handling processing performed in the image forming apparatus shown in FIG. 1.

Figure 6:
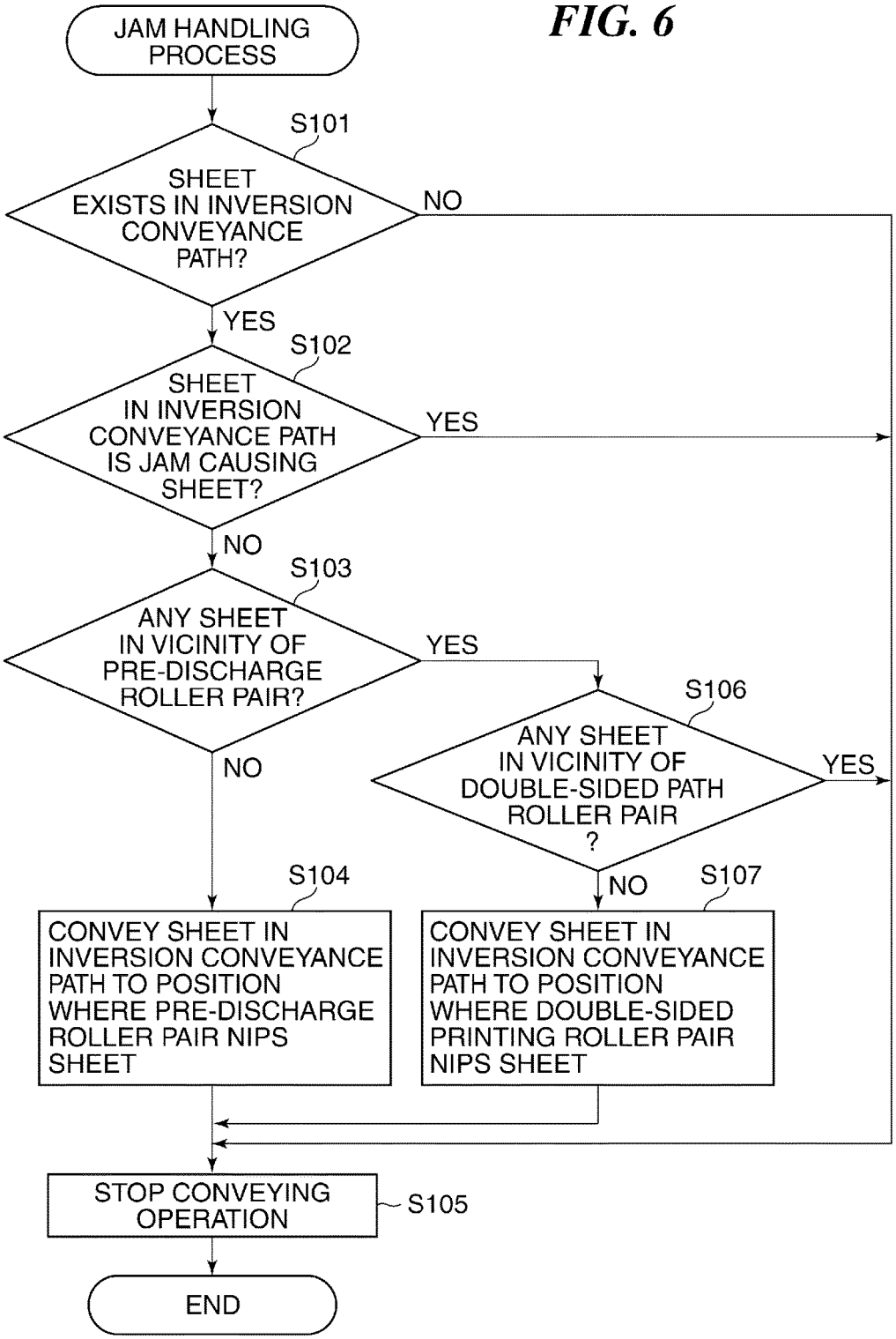
FIG. 6 is a flowchart of a jam handling process performed by the image forming apparatus.

FIG. 6 is a flowchart of a jam handling process performed by the image forming apparatus shown in FIG. 1. This jam handling process is performed by the CPU 201 of the CPU circuit section 204 of the image forming apparatus 100 according to a jam handling process program stored in the ROM 202.

Referring to FIG. 6, in a case where a jam has occurred in the image forming apparatus 100, first, the CPU 201 determines whether or not there is a sheet in the inversion conveyance path 93 (step S101). If it is determined in the step S101 that there is a sheet in the inversion conveyance path 93 (YES to the step S101), the CPU 201 determines whether or not the sheet existing in the inversion conveyance path 93 is a jam causing sheet (step S102). The jam causing sheet is a sheet causing judgment that a jam has occurred. In jam detection and jam handling processing, the CPU 201 manages which sheet has caused the jam, using the RAM 203. Therefore, the CPU 201 determines whether or not the sheet existing in the inversion conveyance path 93 is a jam causing sheet with reference to management information stored in the RAM 203.

If it is determined in the step S102 that the sheet existing in the inversion conveyance path 93 is not a jam causing sheet (NO to the step S102), the CPU 201 proceeds to a step S103. In the step S103, the CPU 201 determines whether or not there is a sheet in the vicinity of the pre-discharge roller pair 79 (step S103). At this time, the CPU 201 determines whether or not there is a sheet in the vicinity of the pre-discharge roller pair 79, based on a signal output from the discharge sensor 112.

If it is determined in the step S103 that there is no sheet in the vicinity of the pre-discharge roller pair 79 (NO to the step S103), the CPU 201 proceeds to a step S104. In the step S104, the CPU 201 conveys the sheet existing in the inversion conveyance path 93 to a position where the sheet is nipped by the pre-discharge roller pair 79. In doing this, the CPU 201 determines whether or not the sheet has been conveyed to the position where the sheet is nipped by the pre-discharge roller pair 79, based on a signal output from the discharge sensor 112.

The following description will be given of an example of jam handling processing for conveying a sheet remaining in the inversion conveyance path 93 to the position where the sheet is nipped by the pre-discharge roller pair 79.

As a place where a jam may occur in the image forming apparatus 100, there are considered for example, five places: (a) the discharge conveyance path 94, (b) the fixing conveyance path 92, (c) the double-sided conveyance path 95, (d) the inversion conveyance path 93, and (e) the sheet feed path 91. Therefore, the following description will be given of jam handling processing for conveying a sheet remaining in the inversion conveyance path 93 to the position where the sheet is nipped by the pre-discharge roller pair 79 for each place where a jam occurs.

(a) Processing for a Jam Having Occurred in the Discharge Conveyance Path 94

Figure 7A:
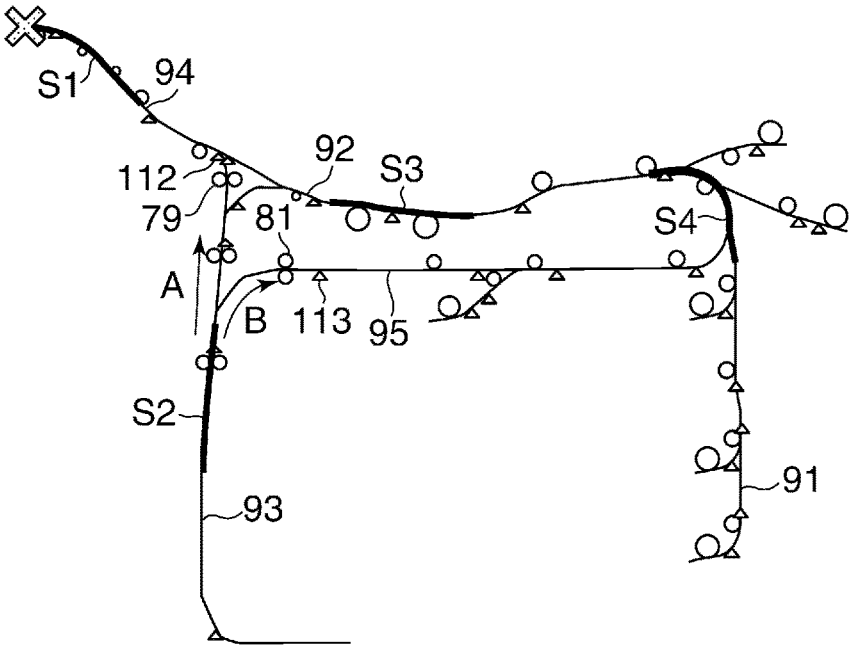
FIGS. 7A and 7B are diagrams each showing a sheet remaining state in a case where a jam has occurred in a discharge conveyance path during inverted discharge of a sheet subjected to single-sided printing.
Figure 7B:
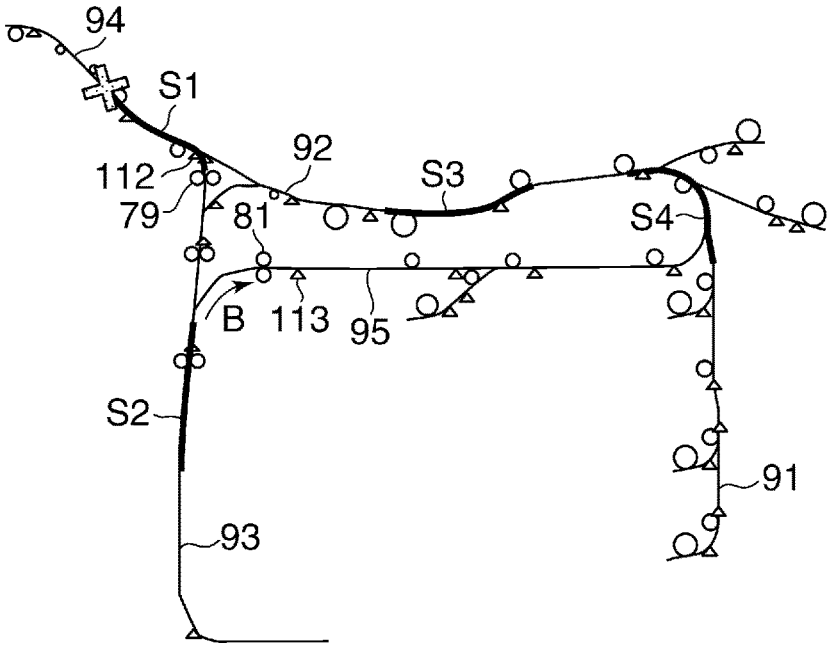

FIGS. 7A and 7B are diagrams each showing a sheet remaining state in a case where a jam has occurred in the discharge conveyance path 94 during inverted discharge of a sheet subjected to single-sided printing. FIGS. 7A and 7B each show a state of occurrence of a jam in which a sheet S1 is jammed within the discharge conveyance path 94.

FIGS. 7A and 7B differ from each other in a position where the sheet S1 is stopped, and whether the sheets are stopped in the state shown in FIG. 7A or 7B is determined depending on a timing in which a jam is detected. That is, in the state shown in FIG. 7A, neither the discharge sensor 112 nor the double-sided path sensor 113 detects a sheet, and there is no preceding sheet in the vicinities of the pre-discharge roller pair 79 and the double-sided path roller pair 81. Therefore, a sheet S2 remaining in the inversion conveyance path 93 is conveyed in a direction A in FIG. 7A, and is stopped at the position where the sheet is nipped by the pre-discharge roller pair 79. This makes it possible to prevent the sheet S2 from falling when the left door 150 is opened.

Further, in this case, by conveying the sheet S2 in a direction B in FIG. 7A, and stopping the sheet S2 at a position where the sheet is nipped by the double-sided path roller pair 81, it is also possible to prevent the sheet S2 from falling when the left door 150 is opened.

Whether to convey a sheet to the position where the sheet is nipped by the pre-discharge roller pair 79 and stop the same there or to convey the sheet to the position where the sheet is nipped by the double-sided path roller pair 81 and stop the same there is not specifically limited. For example, the stop position may be changed according e.g. to the length of a sheet such that the sheet is stopped at the position where the sheet is nipped by the pre-discharge roller pair 79 when the sheet length in a conveying direction is shorter than a predetermined length, and is stopped at the position where the sheet is nipped by the double-sided path roller pair 81 when the sheet length is longer than the predetermined length.

In FIG. 7B, the discharge sensor 112 detects the sheet S1, and hence the preceding sheet exists in the vicinity of the pre-discharge roller pair 79. Therefore, in this case, it is impossible to convey the sheet S2 remaining in the inversion conveyance path 93 to the position where the sheet is nipped by the pre-discharge roller pair 79. Therefore, jam handling processing for conveying the sheet S2 to the position where the sheet is nipped by the double-sided path roller pair 81 is performed. This jam handling processing will be described hereinafter.

Next, in a case where a jam occurs in the discharge conveyance path 94 during double-sided printing, a sheet remaining in the inversion conveyance path 93 is conveyed to the position where the sheet is nipped by the pre-discharge roller pair 79.

Figure 8:
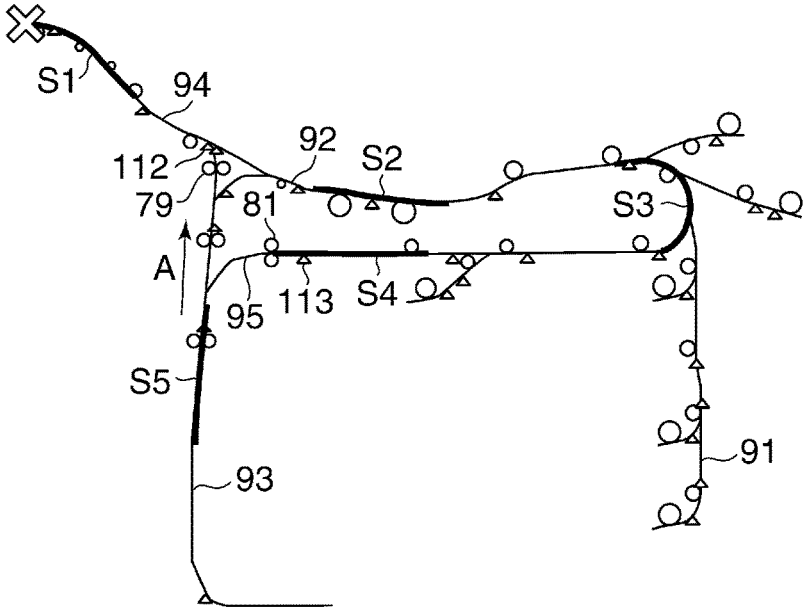
FIG. 8 is a diagram showing a sheet remaining state in a case where a jam has occurred in the discharge conveyance path during double-sided printing.

FIG. 8 is a diagram showing a sheet remaining state in a case where the sheet S1 subjected to printing on the second side is jammed in the discharge conveyance path 94 during double-sided printing. Referring to FIG. 8, when a jam has occurred during double-sided printing, a sheet preceding a sheet S5 remaining in the inversion conveyance path 93 can exist in the vicinity of the double-sided path roller pair 81. If the double-sided path sensor 113 detects a sheet S4, the preceding sheet S4 exists in the vicinity of the double-sided path roller pair 81, and hence it is impossible to convey the sheet S5 remaining in the inversion conveyance path 93 to the position where the sheet is nipped by the double-sided path roller pair 81. Therefore, in this case, the sheet S5 is conveyed in a direction A in FIG. 8 to the position where the sheet is nipped by the pre-discharge roller pair 79 and is stopped.

(b) Processing for a Jam Having Occurred in the Fixing Conveyance Path 92

When a jam has occurred in the fixing conveyance path 92 during single-sided printing, it is possible to discharge a sheet existing in a conveyance path downstream of the fixing conveyance path 92 out of the image forming apparatus 100 (hereinafter this discharge operation is referred to as the "downstream-sheet discharge processing"). In this case, there is no jammed sheet in the discharge conveyance path 94, and hence it is also possible to discharge a sheet which is stopped in the inversion conveyance path 93 via the discharge conveyance path 94 by the downstream-sheet discharge processing.

On the other hand, in a case where a jam has occurred in the fixing conveyance path 92 during double-sided printing, a remaining sheet is handled in the following manner.

Figure 9:
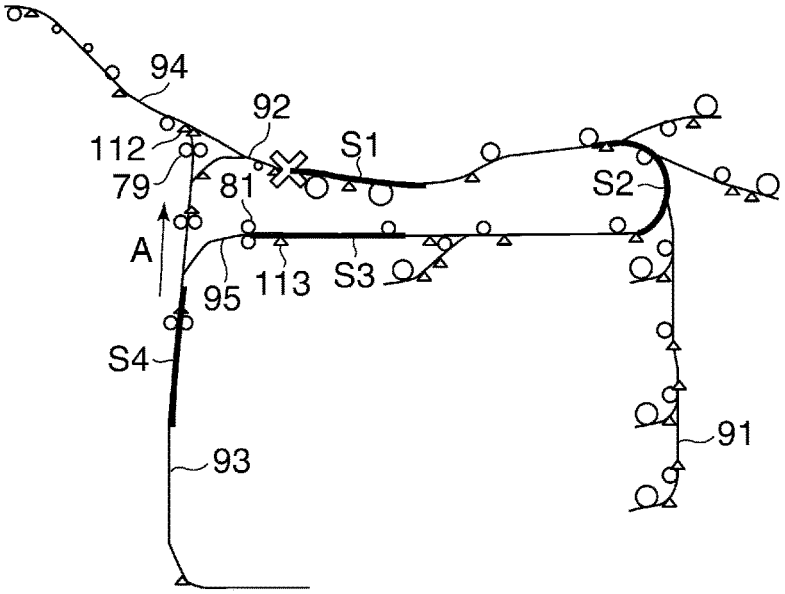
FIG. 9 is a diagram showing a sheet remaining state in a case where a jam has occurred in a fixing conveyance path during double-sided printing.

FIG. 9 is a diagram showing a sheet remaining state in a case where a jam has occurred in the fixing conveyance path 92 during double-sided printing.

Referring to FIG. 9, a sheet S4 remaining in the inversion conveyance path 93 is to be conveyed to the double-sided conveyance path 95 in double-sided print processing, and is not to be discharged out of the image forming apparatus 100 directly from the inversion conveyance path 93 via the discharge conveyance path 94. However, similar to the state shown in FIG. 8, a preceding sheet S3 exists in the vicinity of the double-sided path roller pair 81, and hence it is impossible to convey the sheet S4 to the position where the sheet is nipped by the double-sided path roller pair 81. Therefore, in this case, the sheet S4 remaining in the inversion conveyance path 93 is conveyed in a direction A in FIG. 9 to the position where the sheet is nipped by the pre-discharge roller pair 79 and is stopped.

(c) Processing for a Jam Having Occurred in the double-sided conveyance path 95

In a case where a jam has occurred in the double-sided conveyance path 95, a sheet which is stopped in the inversion conveyance path 93 is conveyed to the position where the sheet is nipped by the pre-discharge roller pair 79.

Figure 10:
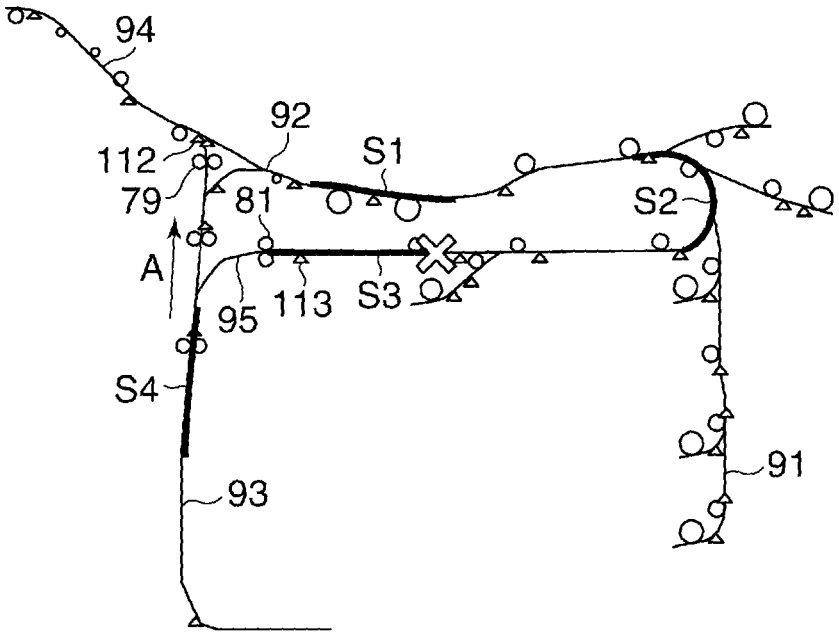
FIG. 10 is a diagram showing a sheet remaining state in a case where a jam has occurred in a double-sided conveyance path during double-sided printing.

FIG. 10 is a diagram showing a sheet remaining state in a case where a jam has occurred in the double-sided conveyance path 95 during double-sided printing. Referring to FIG. 10, a sheet S4 is to be sent to the double-sided conveyance path 95 to be subjected to double-sided printing, and is not to be discharged out of the image forming apparatus 100 directly from the inversion conveyance path 93 via the discharge conveyance path 94. However, a preceding sheet S3 exists in the vicinity of the double-sided path roller pair 81, and hence it is impossible to convey the sheet S4 to the position where the sheet is nipped by the double-sided path roller pair 81. Therefore, in this case, the sheet S4 is conveyed in a direction A in FIG. 10 to the position where the sheet is nipped by the pre-discharge roller pair 79.

Referring again to FIG. 6, after the sheet in the inversion conveyance path 93 has been conveyed to the position where the sheet is nipped by the pre-discharge roller pair 79, the CPU 201 stops the sheet conveying operation of the inversion conveying section (step S105), followed by terminating the present jam handling process.

On the other hand, if it is determined in the step S103 that there is a sheet in the vicinity of the pre-discharge roller pair 79 (YES to the step S103), the CPU 201 determines whether or not there is a sheet in the vicinity of the double-sided path roller pair 81 (step S106). At this time, the CPU 201 determines whether or not there is a sheet in the vicinity of the double-sided path roller pair 81, based on a signal output from the double-sided path sensor 113.

If it is determined in the step S106 that there is no sheet in the vicinity of the double-sided path roller pair 81 (NO to the step S106), the CPU 201 conveys the sheet existing in the inversion conveyance path 93 to the position where the sheet is nipped by the double-sided path roller pair 81 (step S107). At this time, the CPU 201 determines whether or not the sheet has been conveyed to the position where the sheet is nipped by the double-sided path roller pair 81, based on a signal output from the double-sided path sensor 113.

FIG. 7B shows a state in which a jam occurred in which the sheet S1 is stopped in the discharge conveyance path 94 during inverted discharge of a sheet subjected to single-sided printing. More specifically, FIG. 7B shows a state in which when the jam has occurred, there is a preceding sheet in the vicinity of the pre-discharge roller pair 79 and there is no sheet in the vicinity of the double-sided path roller pair 81.

In FIG. 7B, the discharge sensor 112 detects the sheet S1, and there is a preceding sheet in the vicinity of the pre-discharge roller pair 79, and hence it is impossible to convey the sheet S2 remaining in the inversion conveyance path 93 to the position where the sheet is nipped by the pre-discharge roller pair 79. Therefore, in this case, the sheet S2 is conveyed in a direction B in FIG. 7B, and is stopped at the position where the sheet is nipped by the double-sided path roller pair 81. This makes it possible to prevent the sheet S2 remaining in the inversion conveyance path 93 from falling when the left door 150 is opened.

Referring again to FIG. 6, after the sheet in the inversion conveyance path 93 has been conveyed to the position where the sheet is nipped by the double-sided path roller pair 81, the CPU 201 stops the sheet conveying operation of the inversion conveying section (step S105), followed by terminating the present jam handling process.

On the other hand, if it is determined in the step S106 that there is a sheet in the vicinity of the double-sided path roller pair 81 (YES to the step S106), the CPU 201 immediately stops the sheet conveying operation of the inversion conveying section (step S105), followed by terminating the present jam handling process. If there is a preceding sheet in the vicinity of the pre-discharge roller pair 79, and at the same time there is a sheet in the vicinity of the double-sided path roller pair 81, there is no destination to which the sheet existing in the inversion conveyance path 93 is to be conveyed.

Further, if it is determined in the step S101 that there is no sheet in the inversion conveyance path 93 (NO to the step S101), the CPU 201 immediately stops the sheet conveying operation of the inversion conveying section (step S105), followed by terminating the present jam handling process. If there is no sheet in the inversion conveyance path 93, no sheet falls and goes astray even when the left door 150 is opened.

Further, if it is determined in the step S102 that the sheet existing in the inversion conveyance path 93 is a jam causing sheet (YES to the step S102), the CPU 201 immediately stops the sheet conveying operation of the inversion conveying section (step S105), followed by terminating the present jam handling process. The sheet conveying operation of the inversion conveying section is immediately stopped because if the conveying operation is continued for the jam causing sheet, the jammed state can become worse.

According to the jam handling process in FIG. 6, when a jam occurs, it is determined whether or not there is a preceding sheet in the vicinity of the pre-discharge roller pair 79, and if there is no preceding sheet, a sheet remaining in the inversion conveyance path 93 is conveyed to the position where the sheet is nipped by the pre-discharge roller pair 79, and is stopped (step S104). This makes it possible to prevent the sheet S remaining in the inversion conveyance path 93 from falling when the left door 150 is opened to perform jam handling processing.

Further, if there is a preceding sheet in the vicinity of the pre-discharge roller pair 79, it is determined whether or not there is a preceding sheet in the vicinity of the double-sided path roller pair 81, and if there is no preceding sheet, a sheet remaining in the inversion conveyance path 93 is conveyed to the position where the sheet is nipped by the double-sided path roller pair 81, and is stopped (step S107). This also makes it possible to prevent the sheet S remaining in the inversion conveyance path 93 from falling when the left door 150 is opened to perform jam handling processing.

Further, according to the present embodiment, in a case where a jam occurs, a sheet remaining in the inversion conveyance path 93 is conveyed to the position where the sheet is nipped by the existing conveying roller. This makes it possible to prevent the sheet from falling when the left door 150 is opened without adding a special mechanism, and hence it is possible to improve jam handling processing performance while suppressing an increase in the manufacturing cost.

In the present embodiment, when a jam occurs, if there are preceding sheets in the vicinity of the pre-discharge roller pair 79 and in the vicinity of the double-sided path roller pair 81, respectively, the conveyance of a sheet remaining in the inversion conveyance path 93 is stopped. The case where there are preceding sheets in the vicinity of the pre-discharge roller pair 79 and in the vicinity of the double-sided path roller pair 81, respectively, refers to a case where there is preceding sheets within the discharge conveyance path 94 and the double-sided conveyance path 95, respectively. In this case, it is impossible to secure a destination to which the sheet is conveyed, and hence the conveyance of the sheet remaining in the inversion conveyance path 93 is stopped. Further, if a sheet remaining in the inversion conveyance path 93 is a jam causing sheet, the jam causing sheet is not conveyed. This is because the jammed state can become worse.

In the present embodiment, in a case where a jam occurs in the sheet feed path 91, all sheets other than a jam causing sheet can be discharged by downstream-sheet discharge processing. Therefore, a sheet existing in the inversion conveyance path 93 is also conveyed toward the discharge conveyance path 94, and is discharged out of the image forming apparatus 100 via the discharge conveyance path 94.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237394 filed Dec. 4, 2015, which is hereby incorporated by reference herein in its entirety.H

What is claimed is:

1. An image forming apparatus comprising:

a first conveyance path along which a sheet is conveyed;

a door, which can be opened and closed, configured to form a guide wall of said first conveyance path in a closed state;

a first pair of rollers, which are disposed on said first conveyance path, configured to nip and convey the sheet when said door is in the closed state, and that become separated from each other in an open state of said door;

a second conveyance path, which is connected to said first conveyance path, along which the sheet is conveyed from said first conveyance path, in a downstream direction;

a second pair of rollers, which are disposed on said second conveyance path, configured to nip and convey the sheet, and to keep nipping the sheet even when said door is in the open state; and a controller configured to cause, in a case where a jam of the sheet occurs at a position downstream of said second roller pair, a sheet remaining in said first conveyance path to be conveyed into said second conveyance path using said first pair of rollers, and to be nipped by said second pair of rollers.

2. The image forming apparatus according to claim 1, wherein in a case where there is a sheet in the vicinity of said second pair of rollers when a jam occurs, said controller does not cause the sheet remaining in said first conveyance path to be conveyed into said second conveyance path.

3. The image forming apparatus according to claim 1, wherein said second conveyance path is a discharge conveyance path for discharging a sheet out of the apparatus, or a double-sided conveyance path for conveying, in double-sided printing, a sheet having an image formed on a front side thereof to an image forming section, so as to form an image on a reverse side of the sheet having the image formed on the front side thereof.

4. The image forming apparatus according to claim 3, wherein in a case where a sheet remains in the discharge conveyance path and the sheet becomes an obstacle to an operation of causing said second pair of rollers to nip a sheet, said controller causes the sheet remaining in said first conveyance path to be conveyed into the double-sided conveyance path.

5. The image forming apparatus according to claim 3, wherein in a case where a sheet remains in the double-sided conveyance path and the sheet becomes an obstacle to an operation of causing said second pair of rollers to nip a sheet, said controller causes the sheet remaining in said first conveyance path to be conveyed into the discharge conveyance path.

6. The image forming apparatus according to claim 3, wherein in a case where no sheet remains in the discharge conveyance path and the double-sided conveyance path, and the sheet remaining in said first conveyance path has a sheet length shorter than a predetermined length in a sheet conveying direction, said controller causes the sheet remaining in said first conveyance path to be conveyed into the discharge conveyance path.

7. The image forming apparatus according to claim 6, wherein in a case where no sheet remains in the discharge conveyance path and the double-sided conveyance path, and the sheet remaining in said first conveyance path has a sheet length longer than a predetermined length in the sheet conveying direction, said controller causes the sheet remaining in said first conveyance path to be conveyed into the double-sided conveyance path.

8. The image forming apparatus according to claim 1, wherein in a case where the sheet existing in said first conveyance path is a sheet which has caused a jam of the sheet, said controller does not convey the sheet existing in said first conveyance path.

* * * * *